US005733340A

United States Patent [19]

Lauton

[11] Patent Number: 5,733,340

[45] Date of Patent: Mar. 31, 1998

[54] AQUEOUS COMPOSITION FOR THE PRETANNING OF HIDE PELTS OR RETANNING OF LEATHER

[75] Inventor: Alain Lauton, Saint-Louis, France

[73] Assignee: Ciba Specialty Chemicals Corporation, Tarrytown, N.Y.

[21] Appl. No.: 802,648

[22] Filed: Feb. 18, 1997

Related U.S. Application Data

[63] Continuation of Ser. No. 572,411, Dec. 14, 1995, abandoned.

[30] Foreign Application Priority Data

Dec. 15, 1994 [CH] Switzerland ..... 3794/94

[51] Int. Cl.[6] ..... C14C 3/16; C14C 3/28

[52] U.S. Cl. ..... 8/94.33; 8/94.15; 8/94.18; 8/94.2; 8/94.21; 8/94.23; 252/8.57

[58] Field of Search ..... 252/8.57; 8/94.15, 8/94.18, 94.2, 94.21, 94.33

[56] References Cited

U.S. PATENT DOCUMENTS

| | | | |
|---|---|---|---|
| 2,851,329 | 9/1958 | Seligsberger | 8/94.33 |
| 2,941,859 | 6/1960 | Fein et al. | 8/94.33 |
| 2,971,814 | 2/1961 | Seligsberger | 8/94.33 |
| 4,009,996 | 3/1977 | Wurmli | 8/94.24 |
| 5,011,499 | 4/1991 | Rathfelder et al. | 8/94.33 |
| 5,342,916 | 8/1994 | Weiser et al. | 528/150 |
| 5,360,453 | 11/1994 | Lauton et al. | 8/94.33 |
| 5,492,539 | 2/1996 | Bauer et al. | 8/94.33 |

FOREIGN PATENT DOCUMENTS

| | | |
|---|---|---|
| 1176788 | 8/1964 | Germany . |

OTHER PUBLICATIONS

Ullmann's Encyclopedia of Industrial Chemistry 5, Edition, vol. A15, 270–271, 1990 (Month Unknown).

*Primary Examiner*—Alan Diamond
*Attorney, Agent, or Firm*—Kevin T. Mansfield; Michele A. Kovaleski

[57] ABSTRACT

An aqueous composition for the pretanning of hide pelts or for the retanning of leather comprises (A) an aliphatic dialdehyde containing 2 to 8 carbon atoms, (B) an anionic aromatic tanning agent, (C) water and, if desired, (D) an acid. The leather tanned or pretanned with this aqueous composition exhibits a good degree of whiteness and has a high shrinkage temperature.

16 Claims, No Drawings

AQUEOUS COMPOSITION FOR THE PRETANNING OF HIDE PELTS OR RETANNING OF LEATHER

This application is a continuation of application Ser. No. 08/572,411, filed Dec. 14, 1995 now abandoned.

The present invention relates to an aqueous composition for the pretanning of hide pelts or retanning of leather, to a process for the pretanning of hide pelts or retanning of leather, and to the leather treated by this process.

Mineral pretanning and tanning, and especially chrome pretanning and tanning, are of great importance to the production of leather and furs. However, the chromium salt-laden treatment baths which result from such operations cause great problems in that the effluents must be disposed of or cleaned up in a laborious manner. Because of these ecological difficulties, alternative methods are sought which on the one hand are more ecologically acceptable and on the other hand match mineral tanning in the quality of leather obtained.

Although it is known that leather can be tanned with glutardialdehyde even without using chromium salts, the general application of this method is in many cases blocked by the considerably higher price. Moreover, the yellowing of glutardialdehyde-tanned leather is a disadvantage in some cases, for example those in which the leather will subsequently not be dyed or will be dyed only in light shades.

It is also already known, moreover, to tan leather with anionic aromatic tanning agents (syntans), although in this case the shrinkage temperature which can be reached does not meet every requirement.

It has now been found that aqueous compositions comprising a mixture of a dialdehyde and anionic aromatic tanning agents are outstandingly suited to the pretanning of hide pelts or retanning of leather and make it possible to dispense entirely with the use of mineral salts.

Surprisingly, the degree of whiteness is substantially improved in relation to treatment with glutardialdehyde alone, and the shrinkage temperature is adequate. Furthermore, leather treated with such a mixture has a more cohesive structure, the effects of which during subsequent processing, for example when shaving to the desired thickness or when splitting, are advantageous.

The present invention accordingly provides an aqueous composition for the pretanning of hide pelts or retanning of leather, which composition comprises (A) an aliphatic dialdehyde containing 2 to 8 carbon atoms, (B) an anionic aromatic tanning agent, (C) water and, if desired, (D) an acid.

Using the aqueous composition according to the invention it is possible to achieve very good results in pretanning, and the leather has a high shrinkage temperature. Following pretanning, it is possible to carry out a subsequent non-mineral tanning, which is free in particular from chromium salt, in order to produce wet-white leather material; in this case, it is advantageous again to use an aqueous composition according to the invention. However, other customary retanning agents can also be employed.

As dialdehydes (A) it is possible in general to use all dialdehydes or mixtures thereof which have 2 to 8 carbon atoms and structurally saturated aliphatic C—C bonds. Examples are glyoxal, malondialdehyde, succindialdehyde, glutardialdehyde, adipindialdehyde, pimelindialdehyde and octanedialdehyde. Preferred representatives are succindialdehyde, glutardialdehyde, adipindialdehyde and glyoxal, among which glutardialdehyde is in the forefront of interest. The dialdehydes are customarily available as commercial dialdehydes containing from 25 to 50% by weight of water.

Examples of suitable anionic aromatic syntans (B) are those which are obtainable by condensation of sulfonated aromatic compounds alone or together with additional, usually unsulfonated aromatic compounds, with formaldehyde and/or urea.

Examples of aromatic compounds suitable for this purpose are naphthalene, biphenyl, terphenyl, phenols, cresols, 4,4'-dihydroxydiphenyl sulfone, β-naphthol, dihydroxybenzenes, resorcinol, 2,2'-bis(hydroxyphenyl) propane and diaryl ethers, such as diphenyl ether and ditolyl ether, which if desired have been sulfonated in a manner known per se.

Particularly suitable anionic aromatic tanning agents are the following compounds:

(I) condensation products of sulfonated phenol or cresol and formaldehyde, (II) condensation products of naphthalenesulfonic acid and formaldehyde, (III) formaldehyde condensation products of 4,4'-dihydroxydiphenyl sulfones with (hydroxy) arylsulfonic acids, (IV) formaldehyde condensation products of sulfo-containing aromatic hydroxy compounds with aralkyl halides, (V) urea-formaldehyde condensation products of phenols and phenolsulfonic acids, (VI) reaction products of phenol and a sulfonating agent, in which the molar ratio of phenol to $SO_3$ is 1:(1.1–2.2), (VII) condensation products of sulfonated diaryl ethers and formaldehyde, (VIII) condensation products of sulfonated di- or terphenyls and formaldehyde, (IX) condensation products of 4,4'-dihydroxydiphenyl sulfone and sulfonated 4,4'-dihydroxydiphenyl sulfone with formaldehyde, (X) formaldehyde condensation products of diaryl ether sulfonic acid and 4,4'-dihydroxydiphenyl sulfone, and (XI) formaldehyde condensation products of phenol with arylsulfonic acids or hydroxyarylsulfonic acids.

These condensation products are in the form of the free acids, preferably in the form of the sulfonic acids, or as salts, especially lithium, potassium or, in particular, sodium salts.

These condensation products are known, for example from Ullmanns Enzyklop ä die der technischen Chemie [Ullmann's Encyclopedia of Industrial Chemistry] Vol. 16 (4), 138 to 140, (1979), or can be prepared by the processes described in the references given therein.

Suitable acids (D) are both inorganic and organic acids, examples being hydrochloric acid, sulfuric acid, formic acid, acetic acid, citric acid, lactic acid, oxalic acid, benzoic acid, phthalic acid, phenolsulfonic acid, phenolpolysulfonic acid or naphthalenesulfonic acid. It is preferred to use an organic acid, especially acetic acid or formic acid. If the solutions of the anionic aromatic tanning agents already have the desired pH owing to the acid groups present therein, it may be possible if desired to dispense with component (D).

Preferred aqueous compositions according to the invention contain, based on the overall mixture, from 1 to 30%, preferably from 2 to 20%, by weight of component (A), from 10 to 75%, preferably from 20 to 55%, by weight of component (B), sufficient acid to establish a pH of between 0.5 and 6.8, and water to make up to 100%.

Among these compositions, particular preference is given to those which comprise, based on the overall mixture, from 2 to 20% by weight of component (A), from 20 to 55% by weight of component (B), sufficient acid to establish a pH of between 1 and 6.5, and water to make up to 100%.

Based on the mixture of the tanning agents (A) and (B), the proportion of component (A) is preferably between 5 and 95% by weight and the proportion of component (B) is preferably between 5 and 95% by weight.

The aqueous composition according to the invention is expediently prepared by dissolving component (A) in water at a temperature of between 15° and 60° C. and then adding component (B) and, if desired, an acid (D) to the clear solution obtained.

The aqueous coin position obtained in this way is liquid and exhibits good stability on storage.

The aqueous composition according to the invention is suitable per se as an outstanding pretanning agent for all hides and skins, and is used very especially as a precursor in the production of wet-white leathers and furs. After pretanning, a subsequent tanning is possible using, advantageously, an aqueous composition according to the invention again.

For the purpose of pretanning hide pelts, from 1 to 10% by weight, in particular from 4 to 8% by weight, of the aqueous composition according to the invention is used, based on the weight of the hide pelts.

When the aqueous compositions according to the invention are used for retanning leather, it is likewise preferred to employ from 1 to 10% by weight, in particular 4 to 8% by weight, based on the weight of the leather.

Consequently, the present invention additionally provides a process for the pretanning hide pelts and/or for the retanning of leather. The process comprises treating a pickled hide pelt or a pretanned leather in an aqueous liquor comprising (A) an aliphatic dialdehyde containing 2 to 8 carbon atoms, (B) an anionic aromatic tanning agent, (C) water and, if desired, (D) an acid.

For the process according to the invention it is preferred to use an aqueous liquor which comprises (A) glutardialdehyde, (B) an anionic aromatic tanning agent selected from the group consisting of (I) condensation products of sulfonated phenol or cresol and formaldehyde, (II) condensation products of naphthalenesulfonic acid and formaldehyde, (III) formaldehyde condensation products of 4,4'-dihydroxydiphenyl sulfones with (hydroxy) arylsulfonic acids, (IV) formaldehyde condensation products of sulfo-containing aromatic hydroxy compounds with aralkyl halides, (V) urea-formaldehyde condensation products of phenols and phenolsulfonic acids, (VI) reaction products of phenol and a sulfonating agent, in which the molar ratio of phenol to $SO_3$ is 1:(1.1–2.2), (VII) condensation products of sulfonated diaryl ethers and formaldehyde, (VIII) condensation products of sulfonated di- or terphenyls and formaldehyde, (IX) condensation products of 4,4'-dihydroxydiphenyl sulfone and sulfonated 4,4'-dihydroxydiphenyl sulfone with formaldehyde, (X) formaldehyde condensation products of diaryl ether sulfonic acid and 4,4'-dihydroxydiphenyl sulfone, and (XI) formaldehyde condensation products of phenol with arylsulfonic acids or hydroxyarylsulfonic acids, (C) water and, if desired, (D) an acid.

Further additions to the treatment liquor are unnecessary.

Pretanning is carried out, for example, by treating the pickled pelt material with the aqueous composition according to the invention for from 1 to 12 hours at a temperature of between 15° and 45° C. and at a pH of between 1 and 6.5, for example in a rolling drum.

Subsequently, the material thus obtained can be conventionally dewatered and split or shaved to the desired thickness, and then tanned in a customary manner with a mineral tanning agent or preferably, for the production of wet-white material, with vegetable or synthetic tanning agents. This retanning can likewise be carried out with the aqueous composition according to the invention, for example by treating the pretanned leather with the aqueous composition according to the invention for from 1 to 12 hours at a temperature of between 15° and 45° C. and at a pH of between 1 and 6.5, for example in a rolling drum.

If the present process is conducted appropriately, it can also be used to produce ready-tanned leather.

With the present process, the use of mineral salts can be dispensed with entirely.

The percentages and parts in the procedures and examples below are by weight.

EXAMPLE 1

51 parts of naphthalenesulfonic acid are heated with 45 parts of dihydroxydiphenyl sulfone, 30 parts of water and 16 parts of 37% formaldehyde at from 105° to 110° C. for about 2 hours until the condensation product gives a clear solution in water. The product is subsequently diluted with 70 pans of water, rendered weakly acidic with 50 parts of 30% sodium hydroxide solution, and 32 parts of 50% glutardialdehyde and 5 parts of 85% formic acid are added.

A clear, pale solution is obtained which has a pH of from 2.0 to 3.0. The dry matter content is 42% by weight. The solution is stable on storage for at least 1 month even at 35° C. and is outstandingly suited to the pretanning and retanning of leather.

The naphthalenesulfonic acid used is obtained by heating 520 parts of naphthalene and 560 parts of concentrated sulfuric acid at 140° to 160° C. for several hours until the reaction product is completely soluble in water.

The dihydroxydiphenyl sulfone used is obtained by heating 540 parts of phenol and 180 parts of 60% oleum at from 170° to 180° C. for three hours and removing the excess phenol by distillation.

EXAMPLE 2

440 parts of 66% oleum are added slowly at from 60° to 70° C. to 500 parts of melted phenol, and the mixture is subsequently sulfonated at 100° C. for 1 hour. The phenolsulfonic acid formed is then slowly heated at from 160° to 165° C. in a vacuum of from about 11 to 13 mm, so that only a little phenol distils off, and is maintained at this temperature until 1 g of the condensation product neutralizes 3.5 to 3.7 $cm^3$ of 1N sodium hydroxide solution against Congo red. 90 to 100 parts of phenol are added to the condensation product thus formed, and, after the phenol has been mixed in thoroughly, the reaction mixture is again placed slowly under vacuum and heated at 165° C. in a vacuum until 1 g of the condensation product neutralizes only 2.7 to 2.5 $cm^3$ of 1-normal sodium hydroxide solution against Congo red. 100 parts of this condensation product are melted carefully with 54 parts of 30% sodium hydroxide solution, 22 parts of 37% formaldehyde solution are added, and the mixture is then subjected to condensation at from 100° to 105° C. (about 6 hours) until a sample diluted with a little water remains clear down to a pH of 3.5 when acidified with dilute sulfuric acid.

The reaction mixture is then diluted with 100 parts of water, and 33 parts of 50% glutardialdehyde, 3.6 parts of 85% formic acid and 8 parts of 65% phenolsulfonic acid are added.

A clear, pale solution is obtained which has a pH of from 4.5 to 5.5. The dry matter content is 42 % by weight. The solution is stable on storage for at least 1 month even at 35° C. and is outstandingly suited to pretanning and the retanning of leather.

EXAMPLE 3

Following the procedure of Example 2 but using, instead of 54 parts of 30% sodium hydroxide solution, an equivalent quantity of lithium hydroxide gives likewise a solution which is stable on storage and is suitable for pretanning and the retanning of leather.

EXAMPLE 4

478 parts of 20% oleum are added with stirring to 500 parts of melted phenol, with cooling to ensure that the temperature does not exceed 70° C. The mixture is then sulfonated at 105° C. for 1 hour. The phenolsulfonic acid formed is heated slowly at from 150° to 155° C. under reduced pressure of 11 to 13 torr, and this temperature is maintained until 1 g of the condensation product neutralizes 3.8 to 4.0 $cm^3$ of 1-normal sodium hydroxide solution against Congo red. 100 parts of the hydroxyphenyl sulfone-(poly)hydroxyphenyl sulfone monosulfonic acid obtained are melted at 90° C. with 42 parts of water, and 14.4 parts of urea are added. After cooling to 55° C., 38.4 parts of 37% formaldehyde are added dropwise in the course of 2 hours and stirring is continued for about 4 hours until the condensation product gives a clear solution in water.

The reaction product obtained is diluted with 27.6 parts of water and rendered weakly acidic with 37.2 parts of 50% potassium hydroxide solution. Subsequently, 42 parts of 50% glutardialdehyde and 42 parts of 75% acetic acid are added.

A clear, pale solution is obtained which has a pH of from 2.5 to 3.5. The dry matter content is 53 % by weight. The solution is stable on storage for at least 1 month even at 35° C. and is outstandingly suited to pretanning and the retanning of leather.

EXAMPLE 5

55 parts of phenolsulfonic acid are mixed with 25 parts of dihydroxydiphenyl sulfone, 35 parts of water and 56 parts of 30% aqueous sodium hydroxide solution, 61.5 parts of 37% formaldehyde solution are then added, and the mixture is subjected to condensation at from 100° to 105° C. (about 6 hours) until a sample diluted with a little water, on acidification with dilute sulfuric acid, remains clear down to a pH of 3.5.

The reaction mixture is then diluted with 30 parts of water, and 33 parts of 50% glutardialdehyde, 3.6 parts of 85% formic acid and 5 parts of 40 % sulfuric acid are added.

A clear, pale solution is obtained which has a pH of from 4.0 to 5.0. The dry matter content is 40% by weight. The solution is stable on storage for at least 1 month even at 35° C. and is outstandingly suited to pretanning and the retanning of leather.

EXAMPLE 6

100 parts of a pickled calf pelt are treated with 5% of the composition prepared in Example 2 for from 3 to 6 hours at 25° C. in a rolling drum, at a pH of 4.5 established with powdered sodium hydrogen carbonate or sodium formate.

The leather thus treated (wet-white leather) is dewatered and shaved to the desired thickness. This leather is outstandingly suitable for retanning with mineral, vegetable or synthetic tanning agents.

The leather can also be retanned with the same composition prepared in Example 2, to give tanned leather which is free from heavy metals.

What is claimed is:

1. An aqueous composition for the pretanning of a pickled hide pelt or retanning of leather, which consists essentially of (A) an aliphatic dialdehyde containing 2 to 8 carbon atoms, (B) an anionic aromatic tanning agent, (C) water and, optionally, (D) an acid, wherein said composition contains from 1 to 30% by weight of component (A) and from 10 to 75% by weight of component (B).

2. An aqueous composition according to claim 1, wherein component (A) is succindialdehyde, glutardialdehyde, adipindialdehyde or glyoxal.

3. An aqueous composition according to claim 1, wherein component (A) is glutardialdehyde.

4. An aqueous composition according to claim 1, wherein component (B) is a compound selected from the group consisting of (I) condensation products of sulfonated phenol or cresol and formaldehyde, (II) condensation products of naphthalenesulfonic acid and formaldehyde, (III) formaldehyde condensation products of 4,4'-dihydroxydiphenyl surfones with arylsufonic or hydroxyarylsulfonic acids, (IV) formaldehyde condensation products of sulfo-containing aromatic hydroxy compounds with aralkyl halides, (V) urea-formaldehyde condensation products of phenols and phenolsulfonic acids, (VI) reaction products of phenol and a sulfonating agent, in which the molar ratio of phenol to $SO_3$ is 1:(1.1–2.2), (VII) condensation products of sulfonated diaryl ethers and formaldehyde, (VIII) condensation products of sulfonated di- or terphenyls and formaldehyde, (IX) condensation products of 4,4'-dihydroxydiphenyl sulfone and sulfonated 4,4'-dihydroxydiphenyl sulfone with formaldehyde, (X) formaldehyde condensation products of diaryl ether sulfonic acid and 4,4'-dihydroxydiphenyl sulfone, and (XI) formaldehyde condensation products of phenol with arylsulfonic acids or hydroxyarylsulfonic acids.

5. An aqueous composition according to claim 1, wherein component (B) is a lithium, potassium or sodium salt.

6. An aqueous composition according to claim 1, wherein component (D) is an organic acid.

7. An aqueous composition according to claim 6, wherein component (D) is acetic acid or formic acid.

8. An aqueous composition according to claim 1, consisting essentially of from 1 to 30% by weight of component (A), from 10 to 75% by weight of component (B), sufficient acid to establish a pH of between 0.5 and 6.8, and water to make up to 100%.

9. An aqueous composition according to claim 1, wherein the concentrations of (A) and B) with respect to the combined weight of (A) and (B) respectively are from 5 to 95% by weight of component (A) and from 5 to 95% by weight of component (B).

10. A process for pretanning of pickled hide pelts or for the retanning of leather, which comprises treating the pickled pelt or pretanned leather with the aqueous composition according to claim 1 for from 1 to 12 hours at a temperature of between 15° and 45° C. and at a pH of between 1 and 6.5.

11. A process for the pretanning of a pickled hide pelt or for the retanning of leather, which comprises treating a pickled hide pelt or a pretanned leather in an aqueous liquor consisting essentially of (A) an aliphatic dialdehyde containing 2 to 8 carbon atoms, (B) an anionic aromatic tanning agent, (C) water and, optionally, (D) an acid, wherein said aqueous liquor contains from 1 to 30% by weight of component (A) and from 10 to 75% by weight of component (B).

12. A process according to claim 11, wherein an aqueous liquor is used which consists essentially of (A) glutardialdehyde, (B) an anionic aromatic tanning agent selected from the group consisting of (I) condensation products of sulfonated phenol or cresol and formaldehyde, (II) condensation products of naphthalenesulfonic acid and formaldehyde, (III) formaldehyde condensation products of 4,4'-dihydroxydiphenyl sulfones with arylsulfonic or hydroxyarylsulfonic acids, (IV) formaldehyde condensation products of sulfo-containing aromatic hydroxy compounds with aralkyl halides, (V) urea-formaldehyde condensation products of phenols and phenolsulfonic acids, (VI) reaction products of phenol and a sulfonating agent, in which the molar ratio of phenol to $SO_3$ is 1:(1.1–2.2), (VII) condensation products of sulfonated diaryl ethers and formaldehyde, (VIII) condensation products of sulfonated di- or terphenyls and formaldehyde, (IX) condensation products of 4,4'-dihydroxydiphenyl sulfone and sulfonated 4,4'-dihydroxydiphenyl sulfone with formaldehyde, (X) formaldehyde condensation products of diaryl ether sulfonic acid and 4,4'-dihydroxydiphenyl sulfone, and (XI) formaldehyde condensation products of phenol with arylsulfonic acids or hydroxyarylsulfonic acids, (C) water and, optionally (D) an acid.

13. Leather material retanned according to process of claim 11.

14. An aqueous composition for the pretanning of a pickled hide pelt or retanning of leather, which consists essentially of (A) an aliphatic dialdehyde containing 2 to 8 carbon atoms, (B) an anionic aromatic tanning agent, (C) water and, optionally, (D) an acid, wherein said composition contains from 2 to 20% by weight of component (A), from 20 to 55% by weight of component (B), sufficient acid to establish a pH of between 1 and 6.5, and water to make up to 100% by weight.

15. A process for the pretanning of a pickled hide pelt or for the retanning of leather which comprises treating the hide pelt or leather with from 1 to 10% by weight, based on the weight of the leather or of the hide pelt, of an aqueous composition which consists essentially of from 1 to 30% by weight of an aliphatic dialdehyde containing 2 to 8 carbon atoms, from 10 to 75% by weight of an anionic aromatic tanning agent, sufficient acid to establish a pH of between 0.5 and 6.8, and water to make up to 100% by weight.

16. A process according to claim 15, which comprises treating the pickled pelt or pretanned leather with from 4 to 8% by weight, based on the weight of the leather or of the hide pelt, of an aqueous composition which consists essentially of, from 2 to 20% by weight of an aliphatic dialdehyde containing 2 to 8 carbon atoms, from 20 to 55% by weight of an anionic aromatic tanning agent, sufficient acid to establish a pH of between 1 and 6.5, and water to make up to 100%.

* * * * *